US005138396A

United States Patent [19]

Satou et al.

[11] Patent Number: 5,138,396

[45] Date of Patent: Aug. 11, 1992

[54] DEVICE FOR PREVENTING PAPER FROM FALLING IN A TRANSFER DEVICE FOR ELECTROPHOTOGRAPHIC RECORDERS

[75] Inventors: Kouichirou Satou, Hino; Yasuo Fujii, Hachioji, both of Japan

[73] Assignee: Kabushiki Kaisha Toshiba, Kawasaki, Japan

[21] Appl. No.: 713,013

[22] Filed: Jun. 10, 1991

Related U.S. Application Data

[63] Continuation of Ser. No. 474,921, Feb. 5, 1990, abandoned.

[30] Foreign Application Priority Data

Feb. 8, 1989 [JP] Japan ..... 1-13056[U]
Mar. 24, 1989 [JP] Japan ..... 1-33635[U]

[51] Int. Cl.[5] ..... G03G 15/00
[52] U.S. Cl. ..... 355/308; 355/271
[58] Field of Search ..... 355/274, 271, 308, 309, 355/221; 250/324-326

[56] References Cited

U.S. PATENT DOCUMENTS 3,620,617 11/1971 Kelly et al. .
3,850,519 11/1974 Weikel, Jr. .
4,544,262 10/1985 Kanemitsu et al. .
4,926,219 5/1990 Hirasawa et al. ..... 355/309

FOREIGN PATENT DOCUMENTS 19199 8/1982 Japan .
58-91479 5/1983 Japan ..... 355/274
20938 8/1983 Japan .
34298 8/1986 Japan .
62-134667 6/1987 Japan ..... 355/274
62-134669 6/1987 Japan ..... 355/274
265216 6/1987 Japan .
182384 1/1989 Japan .

*Primary Examiner*—R. L. Moses
*Attorney, Agent, or Firm*—Finnegan, Henderson, Farabow, Garrett and Dunner

[57] ABSTRACT

A transfer device used in an electrophotographic recorder capable of effectively prevent paper jamming and transfer missing in a transfer process which comprises a guide member of an insulating material disposed at a downstream side wall end of a casing and an insulating member of current interruption disposed at an upstream side wall end of the casing, in which the guide member, even when subjected to heat, stably keeps its rigidly mounted state and prevents the falling of the paper into an opening of the casing, and the insulating member of current interruption minimizes the flow of a transfer current from a charging wire toward a small-diameter rubber roller to prevent the transfer missing.

30 Claims, 8 Drawing Sheets

DEVICE FOR PREVENTING PAPER FROM FALLING IN A TRANSFER DEVICE FOR ELECTROPHOTOGRAPHIC RECORDERS

This application is a continuation of application Ser. No. 07/474,921 filed Feb. 5, 1990 now abandoned.

BACKGROUND OF THE INVENTION

1. Field of the Invention

The present invention relates to a transfer device for transferring onto a recording paper a toner image formed on a photosensitive body in an electrophotographic recording manner and, in particular, to an improvement in the structure of such a transfer device for preventing paper jamming and transfer missing in the transfer process.

2. Description of the Related Art

Such an electrophotographic recorder as a copying machine, a laser beam printer, or so on has generally such an arrangement as shown in FIG. 14, which includes a photosensitive body 1, a developing unit 2, register rollers 3*a* and 3*b*, a recording paper 4, a register guide 5, a transfer device 6, a fixing guide 7, the parts 2, 3*a*, 3*b*, 4, 5, 6 and 7 being disposed around the photosensitive body 1.

The recorder is arranged so that, as the body turns, the photosensitive body 1 is charged and developed to form a toner image 1*a* on the body and then the toner image 1*a* is transferred onto the recording paper 4 through the transfer device 6.

The transfer device used in such a sort of prior art electrophotographic recorder is arranged so that, as shown in FIG. 15, a charging wire 6*b* is extended within a casing 6*a* of a trough shape made of an electrically conductive material and along the longitudinal direction of the casing 6*a*. More specifically, the charging wire 6*b* is extended as tensioned by holding members 6*c* of an insulating material mounted at both ends of the casing 6*a* to have a suitable tension.

Referring again to FIG. 14, the transfer device 6 is disposed so that an opening of the casing 6*a* is opposed to the periphery of the photosensitive body 1. The casing 6*a* is grounded while the charging wire 6*b* is connected to a voltage application circuit.

In the illustrated example, the casing 6*a* and photosensitive body 1 have a length more than the maximum recording length of the electrophotographic recorder.

In a recording mode, the recording paper 4 is fed into a gap between the photosensitive body 1 and transfer device 6 through the register rollers 3*a* and 3*b* and through the register guide 5, while, the toner image 1*a* formed on the peripheral surface of the photosensitive body 1 is shifted as the body 1 rotates, to a position where the toner image 1*a* faces the transfer device 6.

Applied at this position to the charging wire 6*b* is a voltage that is opposite in polarity to the electric charges of the toner image 1*a* formed on the peripheral surface of the photosensitive body 1.

While the recording paper 4 passes over the opening of the casing 6*a* of the transfer device 6, the discharging operation of the charge wire 6*b* and the electrostatic force of the toner image 1*a* will cause the recording paper 4 to be attracted onto the photosensitive body 1, at which time the toner image 1*a* is transferred onto the recording paper 4 at the same time.

The recording paper 4, after passing through the transfer device 6, is peeled off or released from the photosensitive body 1 naturally by its rigidity or forcingly by mechanical or electrical means and then guided through the fixing guide 7 to a fixing unit.

In the event where the tip end of the recording paper 4 passed through the transfer device 6 is released faster from a position upstream of a predetermined position on the photosensitive body 1, this may cause the paper 4 to be caught in a wall surface of the casing 6*a* of the transfer device 6 so that the paper cannot be fed forward, thus causing paper jamming.

For example, when the recording paper 4 is high in humidity content, the paper 4 becomes low in surface resistance and electric charges carried on the rear face of the paper tend to easily escape therefrom in the transfer device 6, which results in that the tip end of the paper may sometimes be released from the photosensitive body 1 at a position upstream of the predetermined position (that is, released faster than a predetermined timing).

To avoid the above defect, in the prior art transfer device, as shown in FIG. 15, there has been employed such guide means that both side walls of the casing 6*a* are formed respectively to have a plurality of notches 6*d* spaced from each other along the longitudinal direction of the side walls, such a insulating string 6*e* as a fishing string is alternately hooked to the respective notches 6*d* to be extended over the opening of the casing 6*a*, thereby preventing the tip end of the paper 4 from being caught in the opening.

The employment of the above guiding means has been intended to cause the string 6*e* of the transfer device 6 to prevent the falling of the tip end of the paper 4 into the casing 6*a*, thereby ensuring the positive guiding of the paper to the fixing guide 7, even when the tip end of the paper 4 is released faster than the predetermined timing from the photosensitive body 1 at a position upstream of the predetermined position.

The prior art transfer device 6 having the guiding means arranged as mentioned above, however, has had such a problem that, when the string 6*e* extended over the opening of the casing 6*a* is elongated and loosely extended due to the heat generated at the fixing unit provided adjacent to the transfer device 6, the string 6*e* is unhooked from some of the notches 6*d* of the casing 6*a* and thus the extended state of the string 6*e* over the opening is broken which results in that the falling of the tip end of the recording paper 4 into the casing 6*a* cannot be prevented and paper jamming takes place.

Thus, in order to reliably prevent the occurrence of paper jamming in the prior art transfer device 6, it has been necessary to monitor the extended state of the string 6*e* at all times.

FIG. 16 shows an electrophotographic recorder which comprises another prior art transfer device different in structure from the aforementioned prior art transfer device.

The arrangement of electrophotographic recorder of FIG. 16 is substantially the same as that of the recorder of FIG. 14 in that the recorder of FIG. 16 includes a photosensitive body 1, a developing unit 2, register rollers 3*a* and 3*b*, a recording paper 4, a register guide 5, a transfer device 6, a fixing guide 7, the parts 2, 3*a*, 3*b*, 4, 5, 6 and 7 being disposed around the photosensitive body 1. However, the recorder of FIG. 16 is different from the recorder of FIG. 14 in that a feeding rubber roller 8 having a small diameter is provided at a position downstream of the register guide 5 and close to the transfer device 6 in FIG. 16.

In the illustrated example, more specifically, the feeding rubber roller 8 is mounted to neighbor the peripheral surface of the photosensitive body 1. The roller 8 somewhat contributes to preventing the recording paper 4 from falling into the transfer device 6 in the aforementioned transfer process, but the main purpose of the roller 8 is prevent the deterioration of picture quality in the transfer process.

The deterioration of picture quality in the transfer process will first be briefly explained together with the recording operation of the recorder of FIG. 16.

The recording operation of the recorder of FIG. 16 is also carried out based on the aforementioned electrophotographic recording process.

More in detail, in the first exposure process, an electrostatic latent image corresponding to a picture signal is formed on the peripheral surface of the photosensitive body 1.

In the next developing process, the developing unit 2 is rotated in synchronism with the rotation of the photosensitive body 1 to attach developing agent to the electrostatic latent image and form a toner image 1*a*.

The feeding of the recording paper 4 is started from the register rollers 3*a* and 3*b* at a predetermined timing tailored to the exposure and developing processes.

Thereafter, the recording paper 4 passes through the register guide 5 and reaches the photosensitive body 1, from which the paper 4 is fed through the rubber roller 8 along the peripheral surface of the photosensitive body 1 a wound therealong and further fed forward together with the rotation of the body 1.

During the feeding of the paper 4, a transfer process is carried out in such a manner that the transfer device 6 applies corona discharge to the recording paper 4 wound around the photosensitive body 1 from the rear side of the paper to transfer onto the recording paper 4 the toner image 1*a* formed on the body 1.

The recording paper 4 having the toner image 1*a* thus transferred thereonto is peeled off from the photosensitive body 1 at its predetermined position thereon and then guided through the fixing guide 7 to a fixing process station.

In the fixing process station, the toner image 1*a* is positively fixed on the recording paper 4 under the influence of the heating or pressing operation of a fixing unit (not shown) and the paper having the picture image stably recorded thereon is discharged from the recorder.

With the transfer device 6 of the recorder having such an arrangement as mentioned above, when a transfer current applied from the charging wire 6*b* is concentrated on upstream extrusion one of both ends of the casing 6*a* located on the paper input (upstream) side, this tends to cause the reduction of its transfer efficiency and thus the generation of disturbance of picture quality.

To avoid this, the extrusion end of the casing 6*a* has been conventionally covered with an insulating material 9 to thereby impede the invasion of the transfer current into the rubber roller 8.

Further, during execution of the electrophotographic recording process, the rubber roller 8 is charged with the same polarity as the electrode of the transfer device 6 so that, before the recording paper 4 is wound round the photosensitive body 1, the roller 8 attracts the toner image 1*a* attached on the peripheral surface of the body 1, which results in that the picture is scattered and in an extreme example, the leak current causes the machine to stop.

As a prior art countermeasure of eliminating the above problem, a sip ring 10 has been attached to the rubber roller 8 as grounded to prevent the roller 8 from being charged.

In such a sort of transfer device 6, however, the slip ring 10 provided to suppress the rubber roller 8 from being charged, also has promoted the transfer current to be supplied from the transfer device 6 to the rubber roller 8.

As a result, in the transfer process, the transfer current directed from the transfer device 6 to the photosensitive body 1 has been decreased, whereby the transfer has become unstable and the resultant recorded picture has been partly missed.

As has been explained above, this sort of prior art transfer device has had such a problem that, since the grounded rubber roller is disposed very close to the transfer device, most of the transfer current flows into the rubber roller and the net current flowing toward the photosensitive body is decreased to a level below its necessary value, thus resulting in that the picture transfer becomes unstable with picture missing and therefore the record quality is inevitably reduced.

SUMMARY OF THE INVENTION

It is an object of the present invention to provide a reliable transfer device which includes a guide member capable of preventing a recording paper from falling into an opening of a casing and can suppress the generation of a paper jamming phenomenon to a large extent.

Another object of the present invention is to provide a transfer device which can prevent the falling of a recording paper into an opening of a casing, without any need for monitoring the feeding movement of the paper.

A further object of the present invention is to provide a transfer device in which a guide member can be easily mounted to a casing.

Yet another object of the present invention is to provide a transfer device which can feed to a downstream fixing guide a recording paper even after passing through the transfer device, without causing any paper jamming.

Yet another object of the present invention is to provide a transfer device of a type wherein a grounded rubber roller is disposed close to the transfer device, can prevent a transfer current from flowing therefrom into the rubber roller in a transfer process, thus ensuring a good quality of recorded picture without any picture missing during transfer operation.

In accordance with an aspect of the present invention, the above object is attained by providing a transfer device which comprises a casing having an opening opposed to a photosensitive body, a charging wire provided in the interior of the casing, and a guide member of an insulating material provided as extruded over the opening of the casing for guiding a recording paper.

In the present invention, the guide member comprises a plurality of guiding parts and a mounting part molded integral with the plurality of guiding parts.

Further, the guide member is mounted to be higher in positional level than a fixing guide positioned downstream of the transfer device by a step gap therebetween, and the guide member is also mounted to a tip end of the fixing guide without any gap therebetween.

In accordance with another aspect of the present invention, there is provided a transfer device which comprises a casing having an opening opposed to a photosensitive body, a charging wire provided in the interior of the casing, a guide member of an insulating material provided as extruded over the opening of the casing or guiding a recording paper, and an insulating member for current interruption disposed immediately upstream the casing between a paper feeding roller grounded to prevent the roller from being charged with transfer charges and the charging wire for preventing flowing of a transfer current from the charging wire toward the roller.

In the present invention, since the guide member of the insulating material provided as extruded from one end of the casing over the opening thereof is arranged to cover part of the opening of the casing as one component of the transfer device, in this way, the guide member is not subjected to any influence of heat from a fixing unit and can prevent the falling of the paper into the casing to avoid paper jamming and therefore can stably guide the recording paper.

The guide member is highly stable to heat from the fixing unit and unlike a transfer device which uses a string to prevent the falling of the recording paper, the invention can eliminate the need for monitoring whether or not the string became loose due to heat.

In the present invention, since the guide member comprises a plurality of guiding parts and a mounting part molded integral with the plurality of guiding parts, the guide member can be easily and positively mounted to one end of the casing.

Further, since the guide member is mounted to the casing to be higher in positional level than a downstream fixing guide and without any gap therebetween, the paper-jamming preventing function cannot be limited only to the transfer device and can be exerted even on the downstream part.

In the present invention, in addition, the insulating member provided as extended from one end of the casing of the transfer device is positioned as inserted between the charging wire and the paper feeding roller. This enables the complete prevention of the flowing of the transfer current from the transfer device toward the paper feeding roller in the transfer process. As a result, a sufficient level of transfer current can be supplied toward the photosensitive body and a good quality of picture can be obtained without any paper missing and with the stable transfer process.

DESCRIPTION OF THE PREFERRED EMBODIMENTS

Embodiments of the present invention will be detailed by referring to the attached drawings.

Figure 1:
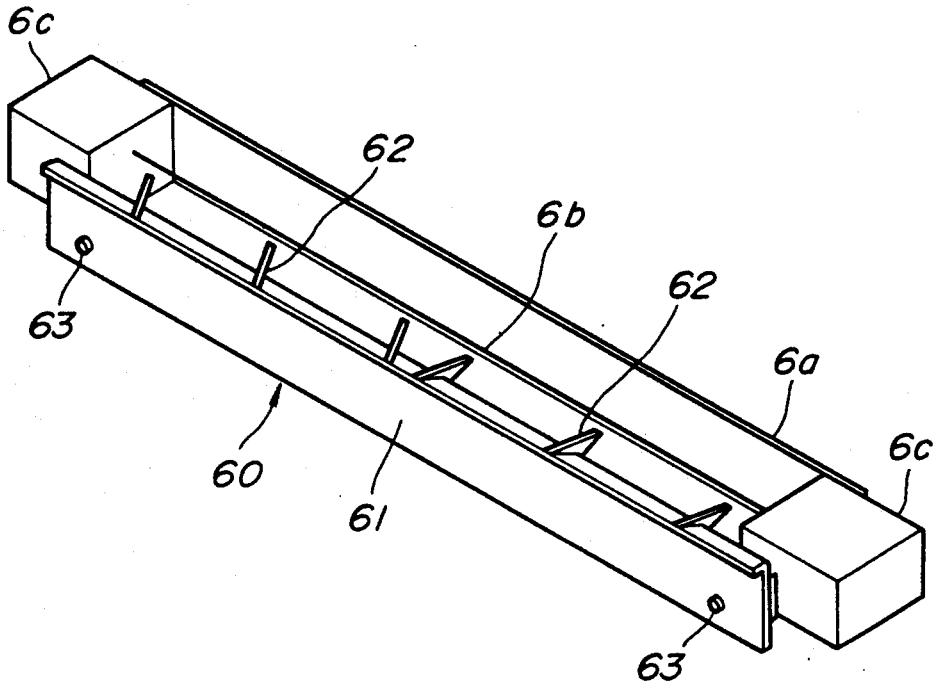
FIG. 1 is a perspective view showing a transfer device in accordance with a first embodiment of the present invention.
Figure 2:
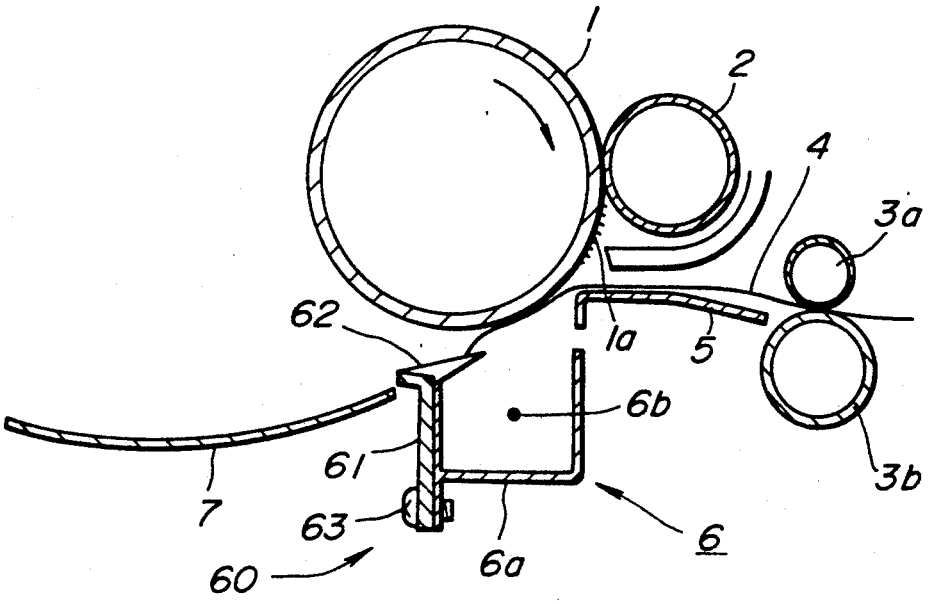
FIG. 2 shows an operational state of the transfer device of the first embodiment.

FIG. 1 shows a perspective view of a transfer device in accordance with an embodiment of the present invention, and FIG. 2 shows an overall arrangement of an electrophotographic recorder having the transfer device of FIG. 1 mounted therein.

Figure 15:
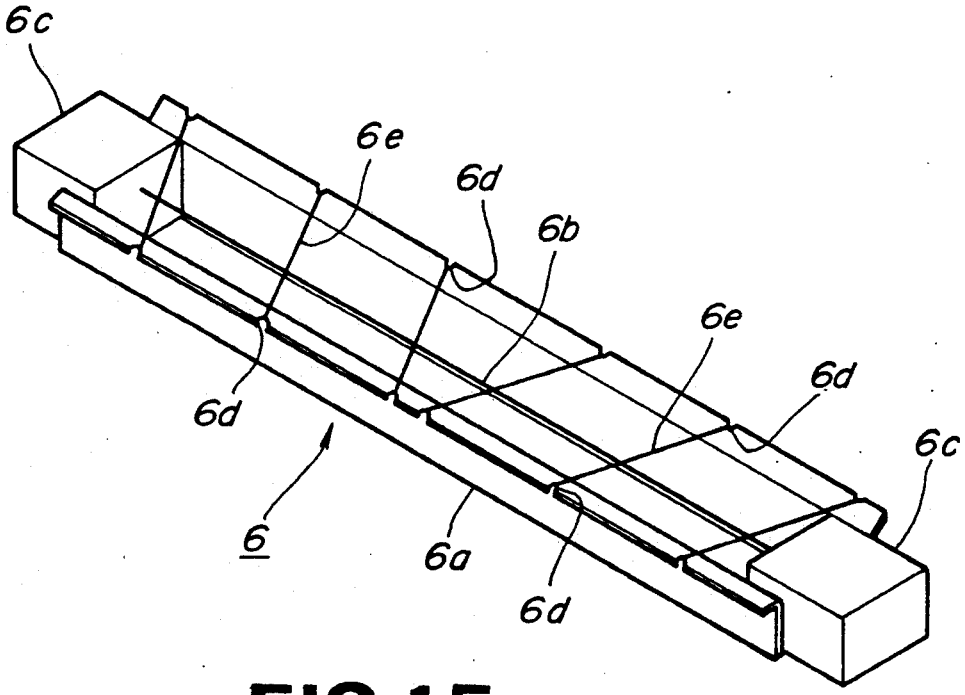
FIG.15 (PRIOR ART)
FIG. 15 is a perspective view of the transfer device used in FIG. 14.
Figure 16:
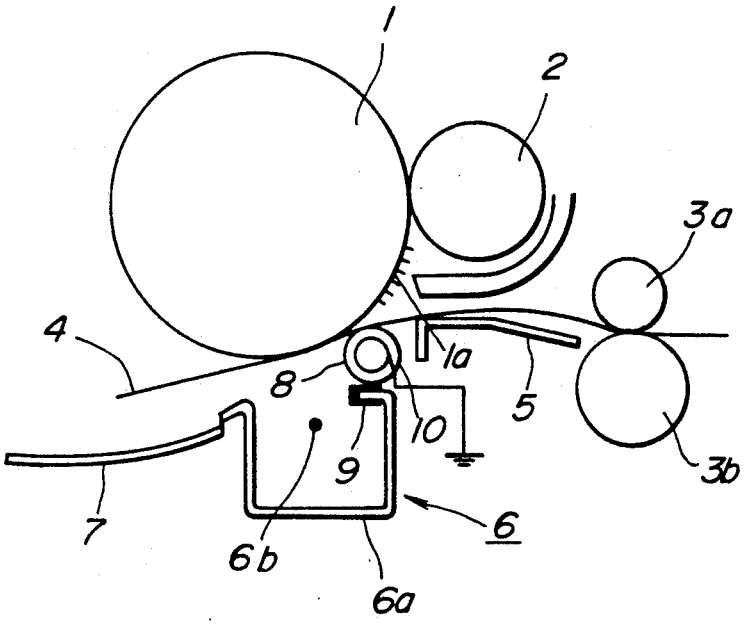
FIG.16 (PRIOR ART)

In the transfer device of the embodiment of FIG. 1 and also used in FIG. 2, the same parts as those in the prior art transfer device of FIG. 15 and used in FIG. 16 are denoted by the same reference symbols, that is, reference symbol 6*a* denotes a casing, 6*b* a charging wire, 6*c* a holding member, respectively.

In the transfer device 6 of the present embodiment, as shown in FIG. 1, a guide member 60 is newly provided as mounted to one of both side walls of the casing 6*a* which is located on the downstream side of the paper feeding direction.

The guide member 60 comprises a mounting part 61 and a plurality of guiding parts 62 which are both made of an insulating resing and which are molded integral with each other. More specifically, the mounting part 61 forms an elongated plate corresponding to one side wall of the casing 6*a*, while the guiding parts 62 are formed on the upper edge of the mounting part 61.

More in detail, the guiding parts 62 have respectively a vane shape which is extended in a direction from the upper edge of the mounting part 61 to its intersection, that is, in the feeding direction of the recording paper 4 so that the guiding parts 62 are positioned symmetrically with respect to the middle of the longitudinal dimension of the mounting part 61 a spaced by an equal distance from each other.

The mounting part 61 is first placed to abut against the downstream in the paper feeding direction) side wall of the casing 6*a* from its outside and then mounted to the same side wall by means of screws 63 provided at both ends of the mounting part 61 as passed therethrough.

In the illustrated embodiment, each of the guiding parts 62 is provided as extruded beyond the downstream side wall of the casing 6*a* into an opening thereof.

In other words, the guiding parts 62 are provided so as to always accept and carry thereon the tip end of the recording paper 4 falling into the opening of the casing 6*a*.

With the transfer device 6 arranged as mentioned above, thus, the falling of the tip end of the paper 4 into the casing 6*a* in the transfer process can be prevented under the influence of the operation which will be explained below.

That is, the transfer device 6 of the present embodiment is mounted in an electrophotographic recorder as shown in FIG. 2.

When the tip end of the recording paper 4, which is already subjected to a transfer operation through the corona discharging operation of the transfer device 6, is released faster than a predetermined timing, that is, from the photosensitive body 1 at a position upstream of a predetermined desired position, the respective guiding parts 62 of the guide member 60 extruded from the downstream side wall into the opening of the casing 6*a* function to accept the tip end of the recording paper 4 falling into the opening of the casing 6*a* and guide the paper 4 toward the fixing guide 7.

Accordingly, the recording paper 4 can be positively prevented from being hooked in the casing 6*a* and being jammed.

Further, the guide member 60 of the transfer device 6 has the mounting part 61 and the guiding parts 62 which are both made of an synthetic resin that is good in insulating property and heat resistance and which also are molded integral with each other to provide an excellent rigidity. Furthermore, the guide member 60 is firmly mounted to the casing 6*a* by means of the screws 63. As a result, it can be avoided that the guide member 60 is deformed or the mounted state thereof is varied due to the heat transmitted from the fixing unit.

Therefore, the guiding parts 62 of the guide member 60 can always stably prevent the falling of the recording paper 4 into the casing 6*a*.

In addition, the guide member 60 can be mounted to the casing 6*a* easily, i.e., by means of the screws 63, and the guide member after mounted requires no special monitoring care with easy maintenance control.

The guide member 60 is not restricted to the specific exemplary arrangement illustrated in the foregoing embodiment but may be modified within the spirit and scope of the invention as set forth in the appended claims.

With regard to the mounting state of the guide member 60, the guide member 60 has been removably mounted to the casing 6*a* in the present embodiment, which is advantageous in that the replacement of the member 60 is easy. However, the member 60 is not limited to the particular arrangement and may be fixed to the casing 6*a* by adhesive-bonding means or other suitable means, as necessary.

Figure 3:
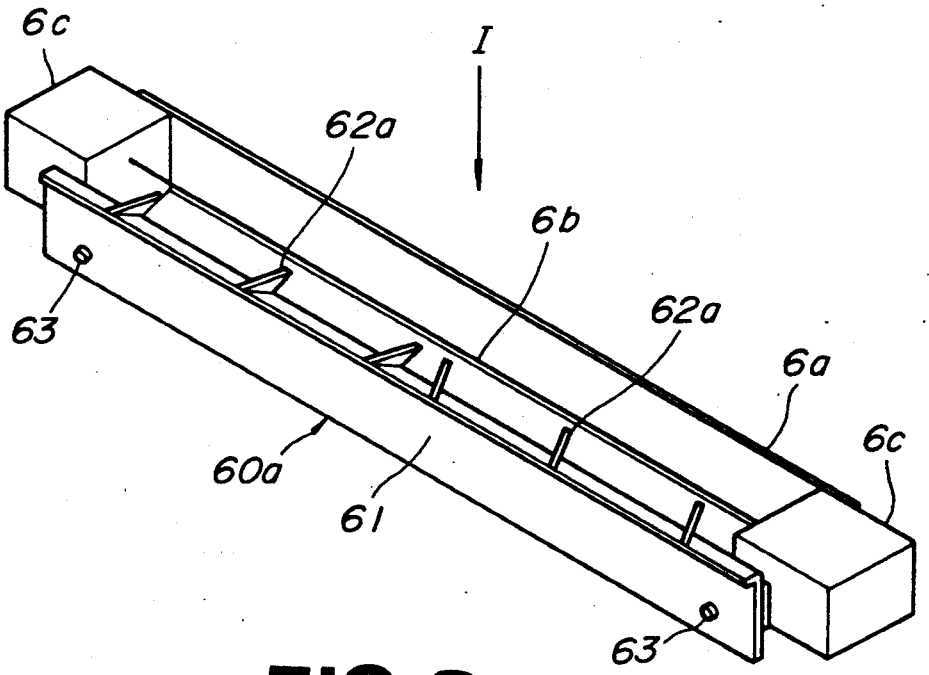
FIG. 3 is a perspective view showing a transfer device in accordance with a second embodiment of the present invention.

An example of modifications of the guide member 60, i.e., a guide member 60*a* is shown in FIG. 3.

The guide member 60*a* of FIG. 3 is different from the guide member 60 of FIG. 1 in that the guiding parts 62 of the guide member 60 are provided as directed mutually convergent toward the feeding direction of the recording paper 4, while respective guiding parts 62*a* of the guide member 60*a* are provided as directed mutually divergent toward the paper feed direction as opposed to the case of FIG. 1.

Generally speaking, the feeding attitude or orientation of the recording paper 4 after peeled off from the photosensitive body 1 depends greatly on the mounted state of the guiding parts and in particular, on the orientation thereof.

Since the guiding parts 62 in FIG. 1 act to cooperatively converge the recording paper 4 along the paper feeding direction, the paper 4 tends to be curved in a mountain shape, thus resulting in that it may become impossible to avoid the occurrence of paper jamming.

For the purpose of eliminating such a defect, the guide member 60*a* of FIG. 3 is provided. That is, the guiding parts 62*a* of the guide member 60*a* act to cooperatively diverge the recording paper 4 along the paper feed direction and even thereafter, also act to smooth the feeding of the paper 4. As a result, the occurrence of paper jamming can be more effectively prevented.

Figure 4A:
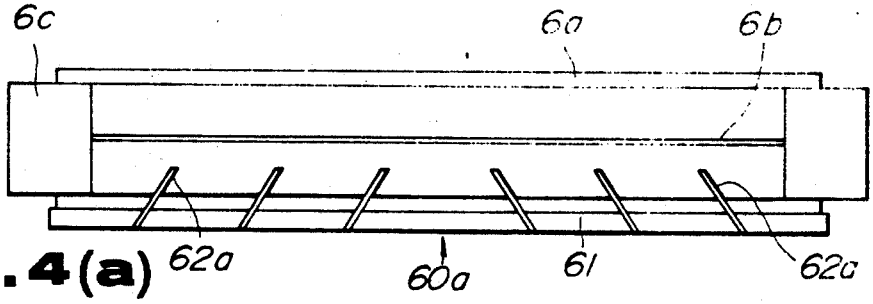
FIGS. 4(*a*) to 4(*c*) show plan views of modifications of the transfer device of the second embodiment, respectively.
Figure 4B:
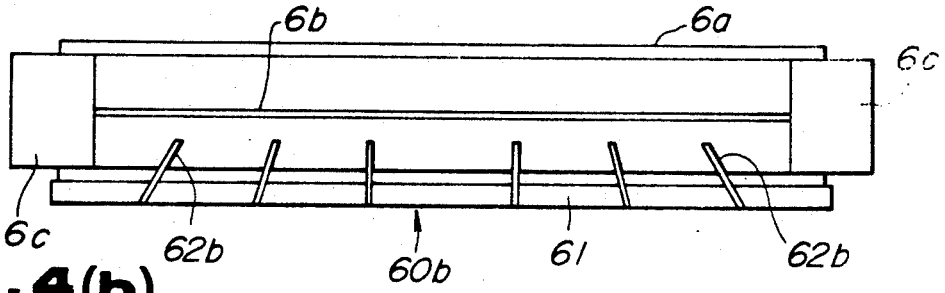
Figure 4C:
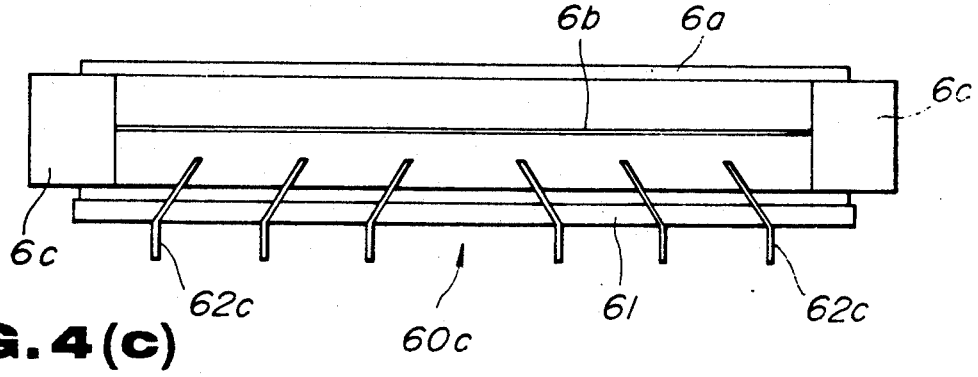

Referring to FIG. 4(*a*), there is shown a plan view of the guide member 60*a* as viewed from a direction shown by an arrow , in which the guiding parts 62*a* provided symmetrically about the middle of the longitudinal mounting part 61 are parallel to each other with respect to adjacent left or right ones.

When consideration is taken of the fact that the mounted orientation of the guiding parts largely affects the subsequent feeding of the recording paper 4, various modifications of the guiding parts other than those shown in FIG. 3 may be considered.

For example, such a guide member 60*b* having guiding parts 62*b* as shown in FIG. 4(*b*) can be considered as one modification. More specifically, the guiding parts 62*b* of the guide member 60*b* are radially provided so that the divergent angles of the outer parts 62*b* of the mounting part 61 are set to be larger than those of the inner parts 62*b*.

Such a guide member 60*c* having guiding parts 62*c* as shown in FIG. 4(*c*) can also be considered as another modification. In the present modification, the guiding parts 62*c* of the guide member 60*c* are formed to respectively have downstream extensions which are directed mutually parallelly in the paper feed direction, thus enabling the more smooth feeding of the recording paper 4.

Figure 5:
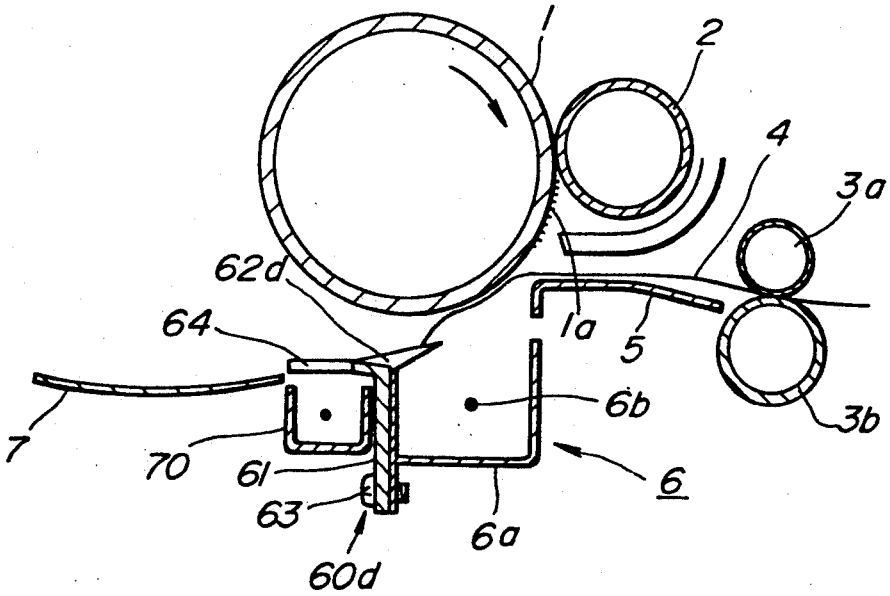
FIG. 5 shows an operational state of a transfer device in accordance with a third embodiment of the present invention.

Meanwhile, in such an electrophotographic recorder as shown in FIG. 5. a releasing charger 70 for providing corona discharge to cause the forcing release of the recording paper 4 is provided close to the transfer device 6 and downstream thereof. The releasing charger 70 comprises a casing having an opening as in the transfer device 6. Accordingly, for the purpose of totally preventing any paper jamming in this sort of electrophotographic recorder, consideration must be paid also to preventing the falling of the recording paper 4 into the opening of the releasing charger 70 after subjected to the transfer process.

Figure 6:
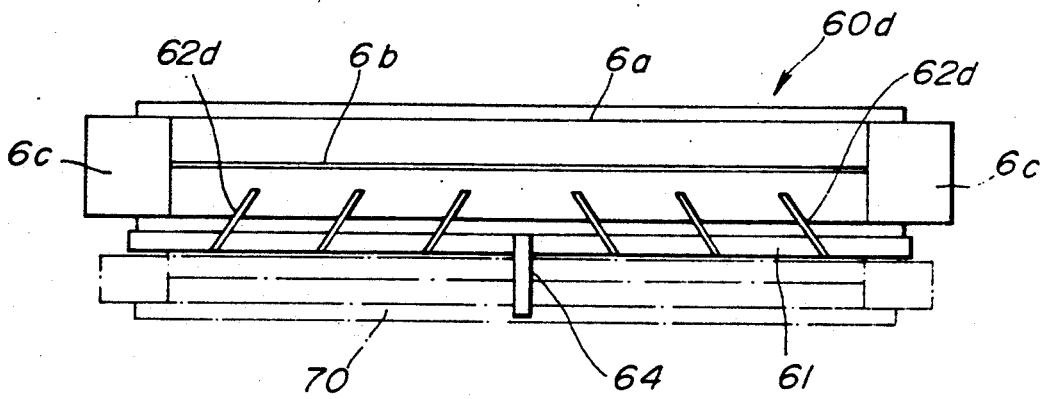
FIG. 6 shows a pan view of the transfer device of the third embodiment.

This can be attained by providing a guide member 60*d* of FIG. 5 with a guiding part 64 which is extended downstream from the mounting part 61 to have such a length as to substantially cover the opening of the guide member 60*d* as shown in FIG. 6.

That is, FIG. 6 is a pan view of the guide member 60*d* similar to FIG. 4, showing the specific structure of the guide member 60*d*, in which guiding parts 62*d* and the guiding part 64 in the guide member 60*d* function to prevent the falling of the recording paper 4 since the parts 62*d* and 64 both cover the opening of the releasing charger 70. In this connection, a plurality of such guiding parts 64 may be provided if necessary.

In the absence of the releasing charger 70, that is, in the case of the recorder of FIG. 2, the fixing guide 7 is disposed immediately downstream of the transfer device 6. In this case, from the viewpoint of paper jamming prevention, special attention must be paid to how the recording paper 4 is smoothly fed from the transfer device 6 to the fixing guide 7.

From the above consideration, for the purpose of completely preventing paper jamming not only over the transfer device 6 but also downstream of the same, the following consideration is desirably given to the mounting between the transfer device 6 and the fixing guide 7 disposed downstread the same.

Figure 7:
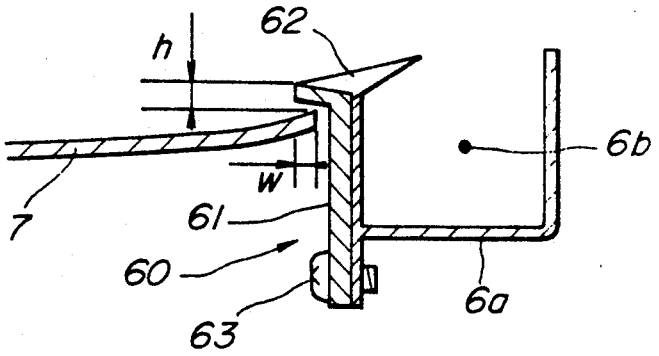
FIGS. 7 and 8 are magnified views of major parts of the transfer devices of the present invention for explaining how to mount the transfer devices, respectively.

More specifically, as shown in FIG. 7 (corresponding to a magnified view of a majar part of FIG. 2), in order to attain the smooth feeding of the recording paper 4 from the transfer device 6 to the fixing guide 7, it is desirable to provide a predetermined step gap between the transfer device 6 and the fixing guide 7.

In this connection, it goes without saying that the upstream guide member 60 is set to be higher in positional level than the downstream fixing guide 7 along the paper feed direction.

It is further desirable to provide the member 60 and the guide 7 without any gap therebetween along the paper feed direction.

From the above consideration, as shown in FIG. 7, the guide member 60 and the fixing guide 7 may be provided as overlapped each other by a width w within the allowable design range. Further, the guide member 60 or the guiding parts 62 thereof may also be arranged as extruded in a direction opposite to the opening of the casing 6a, i.e., in the downstream direction.

Figure 8:
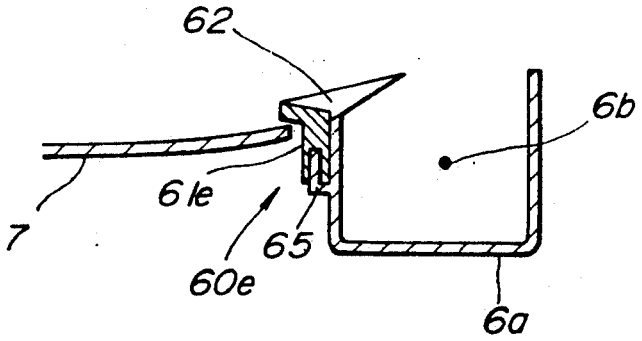

Finally, with regard to the mounting of the guide member 60 to the casing 6a of the transfer device 6, the mounting therebetween may be established not only by means of the screws 63 but also by such means as shown in FIG. 8.

That is, FIG. 8 shows a guide member 60e which includes a member 65 provided in the casing 6a and a mounting part 61e provided integral with the guiding parts 62 and having a recess therein fittably receiving the member 65. In this connection, the fixing between the casing 6a and the mounting part 61e may be carried out by means of both the fitting between the member 65 and the recess of the mounging part 61e and the adhesive bonding therebetween.

Explanation will next be made as to other embodiments with reference to FIGS. 9 to 13.

Figure 9:
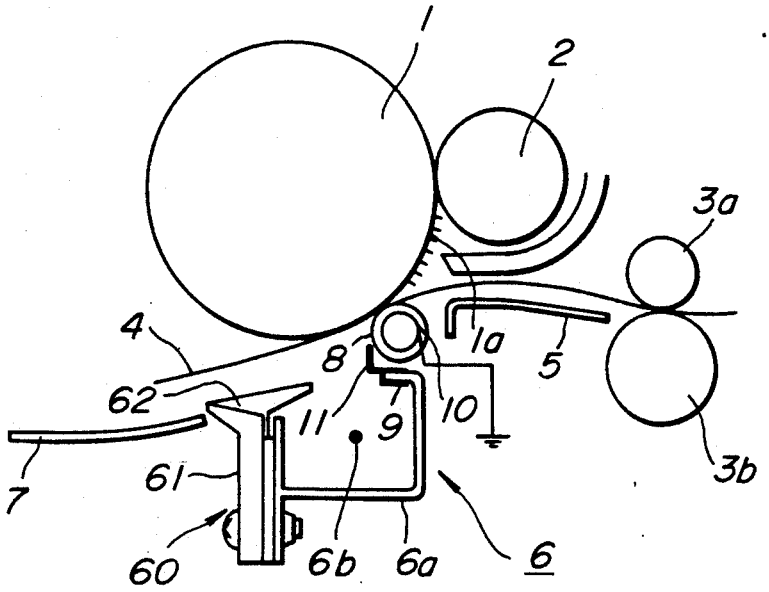
FIG. 9 shows an operational state of a transfer device in accordance with a fourth embodiment of the present invention.

Referring first to FIG. 9, there is shown an electrophotographic recorder in which a rubber roller of a small diameter for paper feeding is provided close to the transfer device 6 and the casing 6a of the transfer device 6 has two side walls one of which is located downstream in the paper feed direction is provided with such a guide member 60 a mentioned above and the other of which is located upstream is provided with an insulating member 11 for current interruption. The arrangement and operation of the guide member 60 have been already explained in the foregoing. The insulating member 11, on the other hand, is provided as extended upwardly from the opening of the casing 6a to interrupt electromagnetic coupling between the charging wire 6b of the transfer device 6 and the rubber roller 8.

In FIG. 9, parts having the same functions as those in the recorder of FIG. 16 are denoted by the same reference numerals or symbols and the recording operation is substantially the same as that of FIG. 16

That is, the photosensitive body 1 is rotated while carrying an electrostatic latent image corresponding to a picture signal on the peripheral surface of the body 1 in the exposure process.

The developing unit 2 functions to apply developing agent to the latent image formed on the peripheral surface of the photosensitive body 1 in synchronism with the rotation of the body 1 to develop the latent image as a toner image 1a.

The recording paper 4 is fed from the resist rollers 3a and 3b through the resist guide 5 and further through the rubber roller 8 reaches the photosensitive body 1, from which the paper 4 is advanced to the transfer position direction along the peripheral surface of the body 1 (that is, with the paper wound round the body 1).

When the transfer device 6 applies corona discharge to the recording paper 4 being fed as wound round the peripheral surface of the photosensitive body 1 from the rear side of the paper, this causes the toner image 1a to be transferred onto the front side of recording paper 4.

The casing 6a of the transfer device 6 for carrying out the transfer process is provided at its one side end with the insulating member 9 which functions to previously suppressing reduction in picture quality.

More in detail, the insulator 9 prevents the transfer current from being concentrated on the extruded end of the upstream side wall of the casing 6a of the transfer device 6 in the transfer process.

The rubber roller 8 is disposed close to both the photosensitive body 1 and the transfer device 6 to function not only to feed the recording paper 4 in an auxiliary manner as mentioned above but also to keep the desirable attitude of the recording paper 4 at the transfer position.

The slip ring 10 attachingly mounted to the rubber roller 8 functions also to suppress reduction in picture quality.

More specifically, during execution of the above electrophotographic recording process, the rubber roller 8 is charged with the same polarity as the electrode (that is, charging wire 6b) of the transfer device 6 so that the rubber roller 8 attract the toner image 1a from the photosensitive body 1 before the paper 4 is wound round the body 1, whereby the picture is scattered or the recorder machine is stopped due to the leak transfer current. In order to avoid such demerit, the sip ring 10 is used to ground the rubber roller 8.

In the recorder of FIG. 9, in addition to these known mechanisms, the insulating member 11 for current interruption is provided onto one end of the casing 6a of the transfer device 6 in such a manner as mentioned above. That is, the insulating member 11 is disposed at a proper position between the charging wire 6b of the transfer device 6 and the rubber roller 8.

Figure 10:
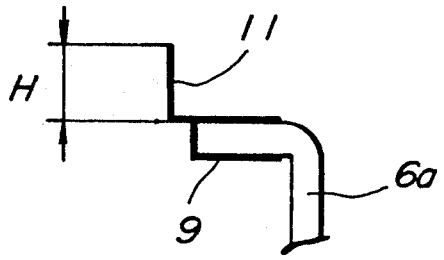
FIG. 10 shows a magnified view of a major part of the transfer device of the fourth embodiment.

Shown in FIG. 10 is a magnified view of an detailed structure of the insulating member 11, which member is molded, for example, in the form of a substantially L-shaped thin plate made of the same insulating material as the insulator 9 previously provided on the upstream side upper end of the casing 6a and the insulating member 11 is fixedly adhesive-bonded to the insulator 9.

The insulating member 11 functionally has a width corresponding to the maximum width of the recording paper 4 in a direction perpendicular to the drawing sheet plane of FIG. 9, as a matter of course.

The insulating member 11 is provided as extruded over the opening of the casing 6a longer than the insulator 9 patially covering the upstream side wall top end of the casing 6a.

With such an arrangement, the present invention having the insulating member 11 in addition to the insulator 9 can reinforce the interrupting ability of the transfer current flowing from the transfer device 6 toward the rubber roller 8 over the prior art having only the insulator 9.

More in detail, in the prior art trasfer device having only the insulator 9 attached thereto, since the grounded rubber roller 8 is provided close to the upstream top end of the casing 6a, the insulator 9 alone cannot sufficiently interrupt the transfer current flowing from the charging wire 6b into the rubber roller 8, which results in that the transfer current flowing toward the photosensitive body 1 is inevitably decreased, causing picture missing. In the present invention, on the other hand, since the additional provision of the insulating member 11 enables the reliable interruption of the transfer current flowing from the transfer device 6 toward the rubber roller 8, the transfer current flowing toward the photosensitive body 1 can be kept at a sufficient level so that stable picture image transfer can be realized without any picture missing.

Figure 11A:
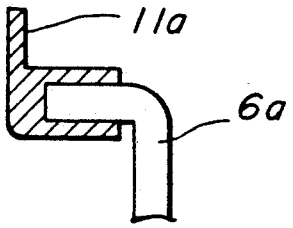
FIGS. 11(*a*) and 11(*b*) show magnified views of majar parts of modifications of the transfer device of the fourth embodiment, respectively.
Figure 11B:
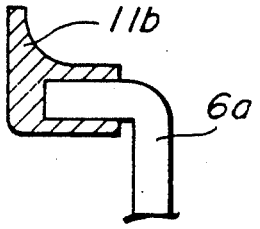

The insulating member 11 used in the transfer device of the present invention may also be modified as shown in FIG. 11. More specifically, FIG. 11(*a*) and (*b*) show insulating members 11a and 11b which are molded integral with the previously provided insulator 9 and which have associated recesses formed simultaneously with the integral molding operation, respectively. The insulating members 11a and 11b are mounted to the upstream top end of the casing 6a by fittingly receiving the upstream top end in the associated recesses respectively. The insulating member 11a shown in FIG. 11(*a*) has a substantially L-shaped cross section, while the insulating member 11b shown in FIG. 11(*b*) has an R-shaped cross section conforming partly to the peripheral surface shape of the rubber roller 8.

Even in both the insulating members 11 of FIG. 11 (*a*) and (*b*), the extrusion length of the members 11 over the opening of the casing 6a must be designed so as not to cover the charging wire 6b taking transfer efficiency into consideration.

Figure 12:
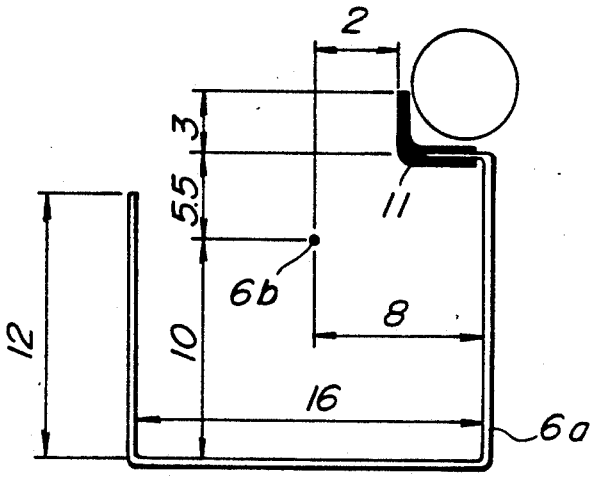
FIG. 12 is a cross-sectional view for explaining the design conditions of the transfer device of the fourth embodiment.

Explanation will be made as to the desirable design dimensions of the transfer device 6 actually employed by the inventors of the present invention, by referring to FIG. 12. The drawing shows a cross-sectional structure of the transfer device of the present invention having the insulating member 11, with the opening of the casing 6a being positioned at the upper side of the drawing. In FIG. 12, in the event where the insulating member 11 of substantially L shape is provided to the upstream upper right end of the casing 6a, the desirable dimensions of the transfer device 6 not to hinder the transfer process and to provide a good quality of picture without any transfer missing are as given in FIG. 12.

In FIG. 12, in particular, a ratio between horizontal dimensions, that is, a length ratio of (a horizontal dimension of from the charging wire 6b to the casing 6a) to (a horizontal dimension of from the wire 6b to the insulator 11) satisfies 8:2=4:1. Further, a ratio between vertical dimensions, that is a ratio of (a vertical dimension of from the charging wire 6b to the casing 6a) to (a vertical dimension of from the casing 6a to the insulator 11) satisfies 5.5:3=11:6.

From tests conducted by the inventors of the present invention with use of the transfer device 6 designed with the above dimensional conditions, it was confirmed that, for example, when a height H (refer to FIGS. 10 and 12) of the insulating member 11 is set to correspond to 3 in ratio with respect to a length of 5.5 from the charging wire 6b to the casing 6a, a transfer current flowing from the transfer device 6 toward the photosensitive body 1 has nearly the same level as when the rubber roller 8 is put in its floated state.

Therefore, the transfer device of the present invention can provide a good quality of picture with the minimized transfer missing.

In addition, since the guide member 60 provided to the downstream side wall of the transfer device 6 of the present invention functions to prevent the falling of the recording paper 4 into the casing 6a, the invention can realize a smooth recording operation without causing any paper jamming.

Figure 13:
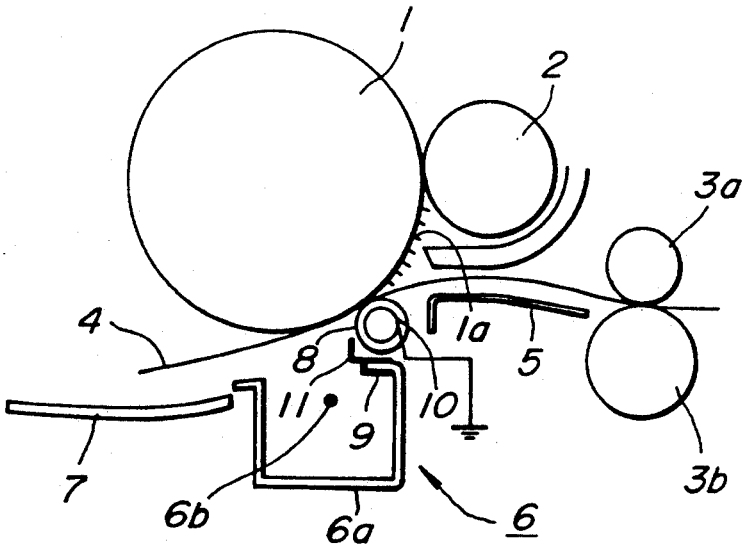
FIG. 13 shows an operational state of a transfer device in accordance with a fifth embodiment of the present invention.
Figure 14:
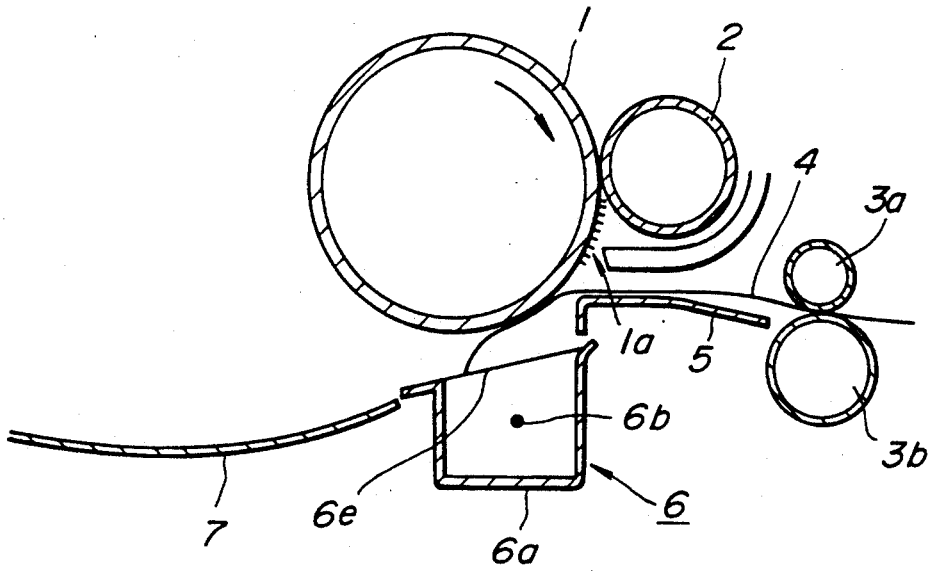
FIG.14 (PRIOR ART)
FIGS. 14 and 16 show operational states of different sorts of prior art transfer devices, respectively.

The present invention may be modified as shown in FIG. 13 as required. That is, in FIG. 13, the guide member 60 provided to the downstream side wall of the casing 6a is removed and only the insulating member 11 provided to the upstream side wall is provided.

What is claimed is:

1. A transfer device used in an electrophotographic recorder to transfer onto a recording paper a toner image formed on a photosensitive body, said transfer device comprising:

a casing having an opening opposed to said photosensitive body;

a charging wire provided in the interior of the opening of said casing; and a guide member, provided at a downstream end of said casing in a paper feed direction, comprising an insulating material provided at one end of said casing so as to form a guiding part for the recording paper, the guide member including an extended portion extended over said opening, said extended portion having a length shorter than a distance between one end of said casing and said charging wire.

2. A transfer device as set forth in claim 1, wherein said guide member includes a plurality of extended portions and a mounting part integrally molded with said plurality of extended portions, said guide member being mounted to said casing by mechanical support of said mounting part.

3. A transfer device as set forth in claim 1, wherein said guide member includes a plurality of extended portions and a mounting part integrally molded with said plurality of extended portions, said mounting part including a recess made simultaneously with the molding operation, said guide member being mounted to said casing by fitting insertion of said casing into the recess of said mounting part.

4. A transfer device used in an electrophotographic recorder to transfer onto a recording paper a toner image formed on a photosensitive body, said transfer device comprising:

a casing having an opening opposed to said photosensitive body;

a charging wire provided in the interior of the opening of said casing; and a guide member comprising an insulating material provided at one end of said casing so as to form a guiding part for the recording paper, the guide member including an extended portion extended over said opening, said extended portion having a length shorter than a distance between one end of said casing and said charging wire, and including a plurality of vane members positioned symmetrically about a longitudinal central portion of said casing.

5. A transfer device as set forth in claim 4, wherein said plurality of vane members are provided so as to diverge downstream, in a paper feed direction, from the longitudinal central portion of said casing.

6. A transfer device as set forth in claim 4, wherein said plurality of vane members are provided so as to diverge downstream from the longitudinal central portion of said casing, and wherein angles at which outer ones of said plurality of vane members diverge are set sequentially larger than those of inner ones thereof.

7. A transfer device used in an electrophotographic recorder to transfer onto a recording paper a toner image formed on a photosensitive body, said transfer device comprising:

a casing having an opening opposed to said photosensitive body;

a charging wire provided in the interior of the opening of said casing; and a guide member comprising an insulating material having an integrally molded recess, said guide member being mounted on one end of said casing by fitting insertion of said casing into said recess, and said guide member having an extended portion extended over the opening of said casing for forming a guiding part for said recording paper.

8. A transfer device as set forth in claim 7, wherein said guide member is provided at a downstream end of said casing in a paper feed direction.

9. A transfer device as set forth in claim 8, wherein said extended portion of said guide member includes a plurality of vane members positioned symmetrically about a longitudinal central portion of said casing.

10. A transfer device as set forth in claim 9, wherein said plurality of vane members are provided so as to diverge downstream from the longitudinal central portion of said casing.

11. A transfer device as set forth in claim 9, wherein said plurality of vane members are provided so as to diverge downstream from the longitudinal central portion of said casing and wherein angles at which outer ones of said plurality of vane members diverge are set sequentially larger than those of inner ones thereof.

12. A transfer device used in an electrophotographic recorder to transfer onto a recording paper a toner image formed on a photosensitive body, said transfer device comprising:

a casing having an opening opposed to said photosensitive body and mounted adjacent to a fixing guide positioned downstream in a paper feed direction within said electrophotographic recorder;

a charging wire provided in the interior of said casing; and a guide member comprising an insulating material having an extended portion which forms a guiding part for the recording paper, said extended portion being extended over the opening of said casing, said guide member being mounted to be higher with respect to gravity than said fixing guide by a stepped cap therebetween.

13. A transfer device as set forth in claim 12, wherein said guide member includes a plurality of extended portions and a mounting part molded integral with said plurality of extended portions, said guide member being mounted to said casing by mechanical support of said mounting part.

14. A transfer device as set forth in claim 12, wherein said guide member includes a plurality of extended portions and a mounting part molded integral with said plurality of extended portions, said mounting part including a recess made simultaneously with the molding operation, and said guide member being mounted to said casing by fitting insertion of said casing into the recess of said mounting part.

15. A transfer device as set forth in claim 13 or 14, wherein said guide member is mounted to a tip end of said fixing guide without any gap therebetween in the paper feed direction.

16. A transfer device as set forth in claim 15, wherein a rear end of said guide member is positioned so as to overlap the tip end of said fixing guide whereby there is no gap.

17. A transfer device as set forth in claim 12, wherein said extended portion of said guide member includes a plurality of vane members positioned symmetrically about a longitudinal central portion of said casing.

18. A transfer device as set forth in claim 17, wherein said plurality of vane members are provided so as to diverge downstream from the longitudinal central portion of said casing.

19. A transfer device as set forth in claim 17, wherein said plurality of vane members are provided so as to diverge downstream from the longitudinal central portion of said casing and wherein angles at which outer ones of said plurality of vane members diverge are set sequentially larger than those of inner ones thereof.

20. A transfer device used in an electrophotographic recorder to transfer onto a recording paper a toner image formed on a photosensitive body, said transfer device comprising:

a casing having an opening opposed to said photosensitive body and mounted adjacent to a releasing charger positioned downstream in a paper feed direction within said electrophotographic recorder;

a charging wire provided in the interior of said casing; and a guide member comprising an insulating material having an extended portion which forms a guiding part for the recording paper, said extended portion being extended over the opening of said casing, and having at least one auxiliary extended portion extended over an opening of said releasing charger.

21. A transfer device as set forth in claim 20, wherein said guide member includes said extended portion, said auxiliary extended portion, and a mounting part integrally molded with said extended portion and said auxiliary extended portion, said guide member being mounted to said casing by mechanical support of said mounting part.

22. A transfer device as set forth in claim 20, wherein said guide member includes said extended portion, said auxiliary extended portion, and a mounting part integrally molded with said extended portion and said auxiliary extended portion, said mounting part being provided with a recess made simultaneously with the molding operation, said guide member being mounted to said casing by fitting insertion of said casing into said recess of said mounting part.

23. A transfer device used in an electrophotographic recorder to transfer onto a recording paper a toner image formed on a photosensitive body, said transfer device comprising:

a casing having an opening opposed to said photosensitive body;

a charging wire provided in the interior of the opening of said casing;

a guide member comprising an insulating material provided as an extended portion over the opening of said casing for guiding said recording paper; and an insulating member for current interruption disposed between said charging wire and a paper feeding roller positioned immediately upstream said casing, the transfer roller being grounded to prevent said roller from being charged with transfer charges, whereby flowing of a transfer current from said charging wire toward said roller is prevented.

24. A transfer device as set forth in claim 23, wherein said insulating member is provided at an upstream end of said casing in a paper feed direction.

25. A transfer device as set forth in either of claims 23 or 24, wherein said insulating member is molded with a recess therein, said insulating member being mounted to said casing by fitting insertion of the casing into said recess of the insulating member.

26. A transfer device as set forth in claim 23, wherein said insulating member has a width more than a maximum width of said recording paper and also has a substantially L-shaped cross sectional shape.

27. A transfer device as set forth in claim 23, wherein said insulating member has a width more than a maximum width of said recording paper and also has an R-shaped cross sectional shape conforming partly to a circumferential shape of said paper feeding roller.

28. A transfer device as set forth in claim 23, wherein said casing has a cross section of a square shape having three solid sides, a fourth side corresponding to said opening of the casing, the opening of said casing being positioned at its upper side, and horizontal dimensions of said casing when viewed from a direction of said cross section being set to satisfy a length ratio of 4:1, the length ratio being a first horizontal length from said charging wire positioned nearly in the vicinity of a center of the casing to said casing with respect to a second horizontal length from the charging wire to said insulating member.

29. A transfer device as set forth in claim 23, wherein said casing has a cross section of a square shape having three solid sides, a fourth side corresponding to the opening of said casing, the opening of said casing being positioned at its upper side, and vertical dimensions of said casing when viewed from a direction of said cross section being set to satisfy a height ratio of 11:6, the height ratio being a first vertical height from said charging wire positioned nearly in the vicinity of a center of said casing to said casing with respect to a second vertical height from said casing to said insulating member.

30. A transfer device used in an electrophotographic recorder to transfer onto a recording paper a toner image formed on a photosensitive body, said transfer device comprising:

a casing having an opening opposed to said photosensitive body;

a charging wire provided in the interior of the opening of said casing; and an insulating member for current interruption disposed between said charging wire and a paper feeding roller positioned immediately upstream said casing, said transfer roller being grounded to prevent said roller from being charged with transfer charges for preventing flowing of a transfer current form said charging wire toward said roller.

* * * * *